US010100599B2

(12) United States Patent
Vasques et al.

(10) Patent No.: US 10,100,599 B2
(45) Date of Patent: Oct. 16, 2018

(54) ANNULAR BARRIER COMPLETION WITH INDUCTIVE SYSTEM

(71) Applicant: WELLTEC A/S, Allerød (DK)

(72) Inventors: Ricardo Reves Vasques, Allerød (DK); Paul Hazel, Aberdeen (GB)

(73) Assignee: Welltec A/S, Allerød (DK)

( * ) Notice: Subject to any disclaimer, the term of this patent is extended or adjusted under 35 U.S.C. 154(b) by 185 days.

(21) Appl. No.: 15/358,940

(22) Filed: Nov. 22, 2016

(65) Prior Publication Data

US 2017/0145777 A1 May 25, 2017

(30) Foreign Application Priority Data

Nov. 23, 2015 (EP) ..... 15195919
Jan. 4, 2016 (EP) ..... 16150086

(51) Int. Cl.
*E21B 17/00* (2006.01)
*E21B 33/127* (2006.01)
(Continued)

(52) U.S. Cl.
CPC ..... *E21B 33/127* (2013.01); *E21B 17/003* (2013.01); *E21B 17/026* (2013.01);
(Continued)

(58) Field of Classification Search
CPC ..... E21B 33/12; E21B 17/003; E21B 17/026; E21B 43/14; E21B 43/26; E21B 47/00; E21B 47/122
See application file for complete search history.

(56) References Cited

U.S. PATENT DOCUMENTS 3,899,631 A 8/1975 Clark
2013/0075087 A1 3/2013 Algeroy et al.

FOREIGN PATENT DOCUMENTS

EP 2 642 066 9/2013
WO WO-2013079574 A1 * 6/2013 ..... E21B 33/1243
(Continued)

OTHER PUBLICATIONS

Extended Search Report for EP 16150086, dated Jul. 4, 2016, 7 pages.
(Continued)

*Primary Examiner* — David J Bagnell
*Assistant Examiner* — Dany E Akakpo
(74) *Attorney, Agent, or Firm* — Nixon & Vanderhye P.C.

(57) ABSTRACT

The present invention relates to a downhole system for completing a well with wireless power and communication downhole, comprising: a first well tubular structure, a second well tubular structure arranged partly inside the first well tubular structure, a first electrical unit comprising a first inductive coupler part and being arranged on an outer face of the first well tubular structure and electrically connected with an electrical conductor, an annular barrier for being expanded in an annulus between a first well tubular structure and a wall of a borehole or another well tubular structure downhole for providing zone isolation between a first zone having a first pressure and a second zone, the annular barrier comprising: a tubular metal part for mounting as part of the first well tubular structure, the tubular metal part having a first expansion opening, an axial extension and an outer face, an expandable sleeve surrounding the tubular metal part and having an inner face facing the tubular metal part and an outer face facing the wall of the borehole, a first connection part and a second connection part configured to connect a first end and a second end, respectively, of the expandable
(Continued)

sleeve with the tubular metal part, and an annular space between the inner face of the expandable sleeve and the tubular metal part, wherein the annular barrier further comprises the electrical conductor extending on the outside of the tubular metal part and within the expandable sleeve from the first connection part to the second connection part, and a second electrical unit comprising a second inductive coupler part and being arranged inside the first well tubular structure and arranged outside the second well tubular structure and configured to abut an inner face of the well tubular structure, wherein the first electrical unit transfers power and/or communication to the second electrical unit. Finally, the present inventor relates to an annular barrier.

18 Claims, 8 Drawing Sheets

(51) Int. Cl.

| | |
|---|---|
| ***E21B 41/00*** | (2006.01) |
| ***E21B 43/14*** | (2006.01) |
| ***E21B 43/26*** | (2006.01) |
| ***E21B 47/00*** | (2012.01) |
| ***E21B 47/12*** | (2012.01) |
| ***E21B 17/02*** | (2006.01) |
| *E21B 47/06* | (2012.01) |
| *E21B 23/00* | (2006.01) |
| *E21B 34/00* | (2006.01) |

(52) U.S. Cl.

CPC ..... *E21B 41/0035* (2013.01); *E21B 43/14* (2013.01); *E21B 43/26* (2013.01); *E21B 47/00* (2013.01); *E21B 47/122* (2013.01); *E21B 47/06* (2013.01); *E21B 47/065* (2013.01); *E21B 2023/008* (2013.01); *E21B 2034/007* (2013.01)

(56) References Cited

FOREIGN PATENT DOCUMENTS

| | | |
|---|---|---|
| WO | WO 2013/184435 | 12/2013 |
| WO | WO 2015/051222 | 4/2015 |

OTHER PUBLICATIONS

International Search Report and Written Opinion dated Mar. 22, 2017 in International Application No. PCT/EP2016/078422 (19 pages).

* cited by examiner

ANNULAR BARRIER COMPLETION WITH INDUCTIVE SYSTEM

This application is claims priority to EP Patent Application No. 15195919.4 filed 23 Nov. 2015 and EP Patent Application No. 16150086.3 filed 4 Jan. 2016, the entire contents of each of which are hereby incorporated by reference.

FIELD OF THE INVENTION

The present invention relates to an annular barrier for being expanded in an annulus between a well tubular structure and a wall of a borehole or another well tubular structure downhole for providing zone isolation between a first zone having a first pressure and a second zone. Furthermore, the present invention relates to a downhole system.

BACKGROUND ART

In recent years, the number of tool intervention operations in wells has increased, and hydrocarbon wells are therefore made without electrical lines running inside the casing which may conflict with intervention tools. Some designs insert an inner string into the completion where the electrical conductors run on the outside of the inner string. Consequently, the inner diameter of the completion is thereby substantially reduced which is not desirable. The inner diameter is decreased when providing electricity downhole by means of the inner string solution, and in order to compensate for that and have a well design with an unchanged inner diameter, the overall diameter of the well has to be enlarged accordingly. Consequently, the costs of the completion increase substantially, which is also not desirable.

However, electricity is still needed for powering electrical devices arranged inside or outside the casing several kilometers down, as the completions become more and more developed, and this conflicts with the importance of keeping the casing free of electrical lines without breaking the main barriers of the well while obtaining an inner diameter which is as large as at all possible so that the production is kept efficient.

SUMMARY OF THE INVENTION

It is an object of the present invention to wholly or partly overcome the above disadvantages and drawbacks of the prior art. More specifically, it is an object to provide an improved annular barrier and downhole system in which powering of electrical devices arranged inside or outside a well tubular structure several kilometers down is possible while still being able to perform tool intervention without decreasing the inner diameter or increasing the overall outer diameter of the well.

The above objects, together with numerous other objects, advantages and features, which will become evident from the below description, are accomplished by a solution in accordance with the present invention by a downhole system for completing a well with wireless power and communication downhole, comprising:

- a first well tubular structure,
- a second well tubular structure arranged partly inside the first well tubular structure,

- a first electrical unit comprising a first inductive coupler part and being arranged on an outer face of the first well tubular structure and electrically connected with an electrical conductor,
- an annular barrier for being expanded in an annulus between a first well tubular structure and a wall of a borehole or another well tubular structure downhole for providing zone isolation between a first zone having a first pressure and a second zone, the annular barrier comprising:
  - a tubular metal part for mounting as part of the first well tubular structure, the tubular metal part having a first expansion opening, an axial extension and an outer face,
  - an expandable sleeve surrounding the tubular metal part and having an inner face facing the tubular metal part and an outer face facing the wall of the borehole,
  - a first connection part and a second connection part configured to connect a first end and a second end, respectively, of the expandable sleeve with the tubular metal part, and
  - an annular space between the inner face of the expandable sleeve and the tubular metal part,
    wherein the annular barrier further comprises the electrical conductor extending on the outside of the tubular metal part and within the expandable sleeve from the first connection part to the second connection part, and
- a second electrical unit comprising a second inductive coupler part and being arranged inside the first well tubular structure and arranged outside the second well tubular structure and configured to abut an inner face of the well tubular structure, wherein the first electrical unit transfers power and/or communication to the second electrical unit.

By having the first electrical unit arranged on the outer face of the first well tubular structure and the second electrical unit arranged inside the first well tubular structure, the downhole system can be made having a larger diameter than if an inner string had to be inserted in order to communicate with sensors further down the borehole. In the design of the present invention, the electrical conductors do not require an inner string conducting electricity or communication to an outer string since the electrical conductors run on the outside of the well tubular structures and transfer power and/or communication from the outer casing to the inner casing and not the other way around, as is the case in prior art solutions. This design is possible since the annular barriers having the electrical conductors extend through the connecting parts of the annular barriers, and in this way the electrical conductors are protected while the well tubular structure are run in hole.

The connecting parts of the annular barriers connect the expandable metal sleeve to the tubular metal part and are formed as tubular connection parts, making room for the electrical conductors to run in bores in the connection parts.

Furthermore, electrical conductors have become more robust and can now be made in such way that they can withstand the environment in the borehole, and thus the solution of the present invention has become more feasible. By avoiding an inner string, the inner diameter is not decreased, and by running the electrical conductors on the outside, the overall outer diameter is also not increased.

In one embodiment, an outer face of the second well tubular structure may face the wall of the borehole.

Also the second electrical unit may be electrically connected to a third electrical unit via a second electrical conductor.

The downhole system described above may further comprise a second annular barrier through which the second electrical conductor may extend.

Furthermore, the tubular metal part of the second annular barrier may be a part of the second well tubular structure.

Moreover, the downhole system may comprise a lateral tubular structure connected with one of the well tubular structures, and wherein a third electrical unit may be arranged outside the lateral tubular structure.

In one embodiment, the downhole system may comprise a tool arranged in the second well tubular structure, the tool comprising an inductive tool coupler part configured to be electrically connected with the inductive coupler part.

In another embodiment, the downhole system may comprise a sensor arranged outside one of the second well tubular structures.

In yet another embodiment, the downhole system may comprise a sensor arranged outside of the lateral tubular structure.

Furthermore, the annular barrier may comprise a tunnel arranged in the space between the first connection part and the second connection part, in which tunnel the electrical conductor may extend.

Additionally, the connecting parts of the annular barriers connecting the expandable sleeve to the tubular metal part may be formed as tubular connection parts having a bore through which bore the electrical conductor may run.

Also, the first electrical unit and the second electrical unit may communicate wirelessly through the first well tubular structure.

In an embodiment, the electrical unit may be an inductive coupler part.

The downhole system may further comprise a second well tubular structure arranged at least partly within a first well tubular structure, the second electrical unit being arranged outside the second well tubular structure.

The downhole system may further comprise several annular barriers, where the tubular metal parts of the annular barriers are mounted as part of the first well tubular structure and/or the second well tubular structure.

The present invention furthermore relates to an annular barrier for being expanded in an annulus between a well tubular structure and a wall of a borehole or another well tubular structure downhole for providing zone isolation between a first zone having a first pressure and a second zone, the annular barrier comprising:

- a tubular metal part for mounting as part of the well tubular structure, the tubular metal part having a first expansion opening, an axial extension and an outer face,
- an expandable sleeve surrounding the tubular metal part and having an inner face facing the tubular metal part and an outer face facing the wall of the borehole,
- a first connection part and a second connection part configured to connect a first end and a second end, respectively, of the expandable sleeve with the tubular metal part, and
- an annular space between the inner face of the expandable sleeve and the tubular metal part, wherein the annular barrier further comprises an electrical conductor extending from the first connection part to the second connection part, and wherein the annular barrier further comprises a tunnel arranged in the space between the first connection part and the second connection part, in which tunnel the electrical conductor extends.

By having the electrical conductor extending from and through the first connection part via the annular space to and through the second connection part, electricity can be supplied to an electric device further down the well without breaking the barrier between the first zone and the second zone. The connection parts do not move, and it is thus simple to provide a sufficient seal between the connection parts and the electrical conductor. Furthermore, the connection parts protect the electrical conductor while running the well tubular structure in hole, and the tunnel protects the electrical conductor while expanding the annular barrier and the tunnel slightly collapse around the electrical conductor in the annular space without damaging the electrical conductor.

Thus, the connection parts may be non-slidable in relation to the tubular metal part.

Furthermore, the first connection part and the second connection part may each have an electrical connection configured to connect with the electrical conductor.

The annular barrier described above may further comprise a sealing means for sealing around the electrical conductor.

In addition, the electrical conductor may be soldered to the connection parts.

Also, the sealing means may seal around the electrical conductor between the electrical conductor and one of the connection parts or the tunnel.

In addition, the annular barrier described above may further comprise a sensor and/or a communication unit for communicating data from the sensor, the sensor and/or the communication unit may be electrically connected with the electrical conductor.

Also, the connecting parts of the annular barriers connecting the expandable sleeve to the tubular metal part may be formed as tubular connection parts having a bore through which bore the electrical conductor may run.

The expandable sleeve may be made of metal so that the annular barrier is a metal annular barrier.

Furthermore, at least one sealing means may be provided on the outer face of the expandable sleeve of the metal annular barrier.

Also, the annular barrier may comprise an expansion unit so that fluid passing the expansion opening is led past the expansion unit before entering the annular space.

The expansion unit may have an initial position allowing fluid to flow from the inside of the well tubular structure and into the annular space and a first position allowing fluid to flow between the annular space and the annulus. In the initial position, there is no fluid communication between the annular space and the annulus and in the first position the fluid communication between the annular space and the inside of the well tubular structure is closed.

In addition, the expansion unit may comprise a permanent closing mechanism for preventing fluid communication between the well tubular structure and the annular space in a first position.

Furthermore, the permanent closing mechanism is a two-way valve comprising a second position in which fluid communication between the annular space and the annulus or the second zone is provided.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
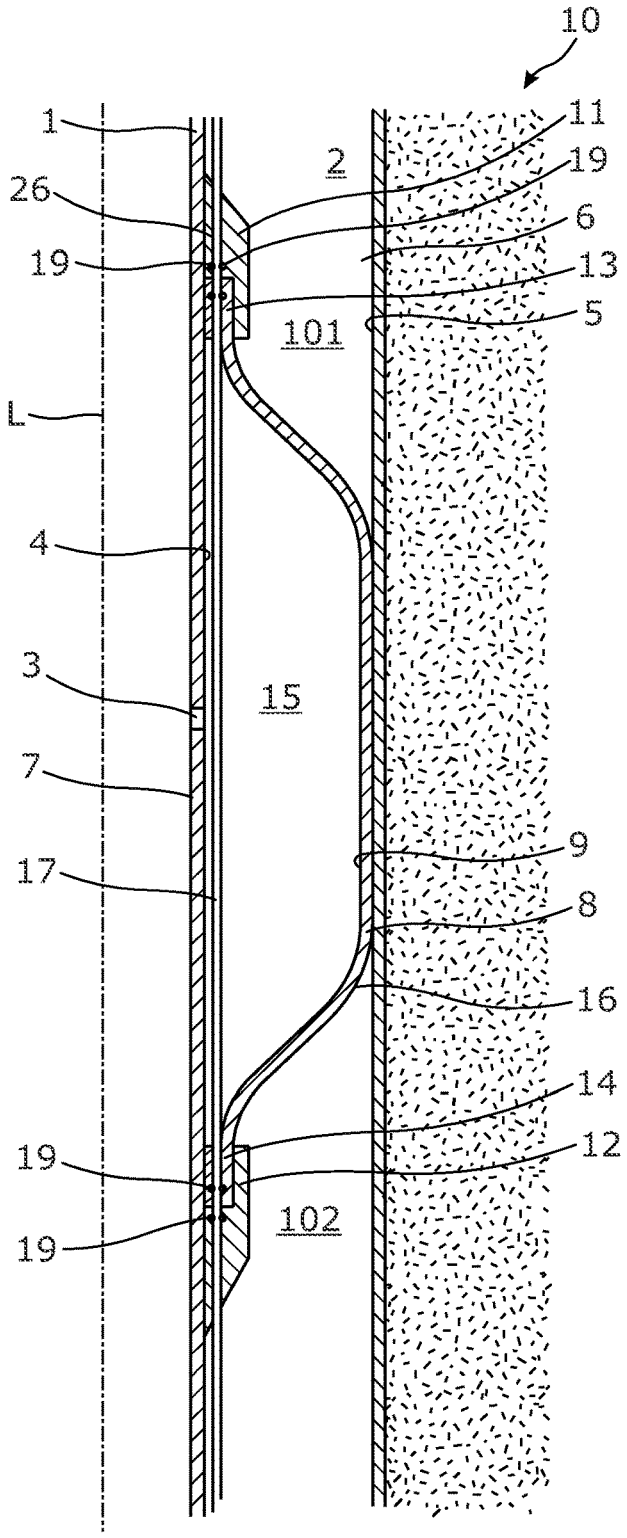
FIG. 1 shows a cross-sectional view of an annular barrier having an electrical conductor.

FIG. 1 shows an annular barrier 10 in a well, expanded in an annulus 2 between a well tubular structure 1 and a wall 5 of another well tubular structure downhole for providing zone isolation between a first zone 101 and a second zone 102. The annular barrier 10 comprises a tubular metal part 7 for mounting as part of the well tubular structure 1, the tubular metal part having an axial extension L along the longitudinal extension of the well tubular structure. The tubular metal part 7 has a first expansion opening 3 through which pressurised fluid enters for expanding the annular barrier 10. The annular barrier 10 further comprises an expandable sleeve 8 surrounding the tubular metal part 7 and having an inner face 9 facing an outer face 4 of the tubular metal part, and an outer face 16 of the expandable sleeve 8 faces the wall of the well tubular structure 1. A first end 13 of the expandable sleeve 8 is connected to the tubular metal part 7 by a first connection part 11, and a second end 14 of the expandable sleeve is connected to the tubular metal part 7 by a second connection part 12. Thus, an annular space 15 is enclosed between the inner face 9 of the expandable sleeve 8 and the tubular metal part 7, which annular space 15 expands as the expandable sleeve 8 expands due to the pressurised fluid let into the annular space 15. The annular barrier 10 further comprises an electrical conductor 17 extending through the first connection part, from the first connection part 11 to the second connection part 12, through the annular space 15 and through the second connection part so that electricity can be conducted past the annular barrier 10 to an electrically demanding unit, e.g. a sensor 23 or a tool, further down the well without breaking the seal between the first zone 101 and the second zone 102 provided by the annular barrier. The electrical conductor is thus protected by the connection parts as the well tubular structure is run in hole since the connection parts are the components which may bump into the wall of the borehole as the well tubular structure is run in hole.

Figure 2:
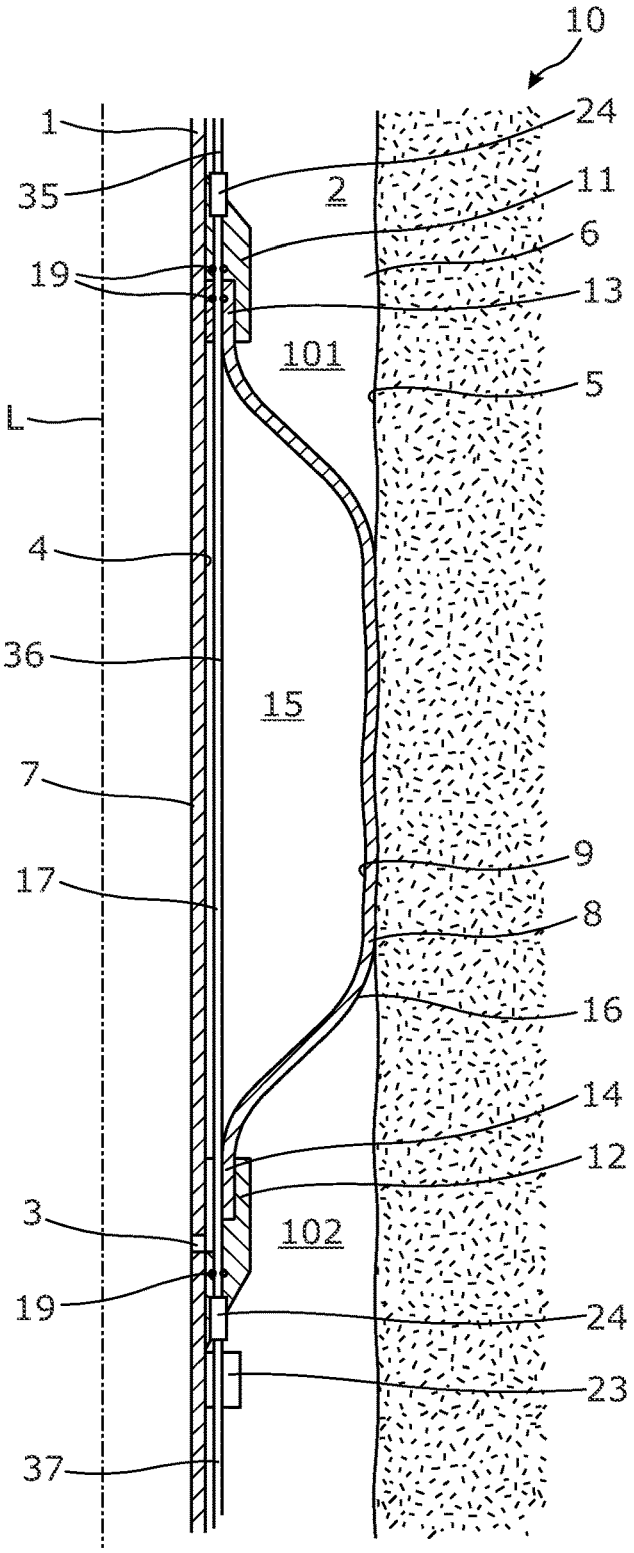
FIG. 2 shows a cross-sectional view of an annular barrier having an electrical conductor connected to connection parts via electrical connections.
Figure 3:
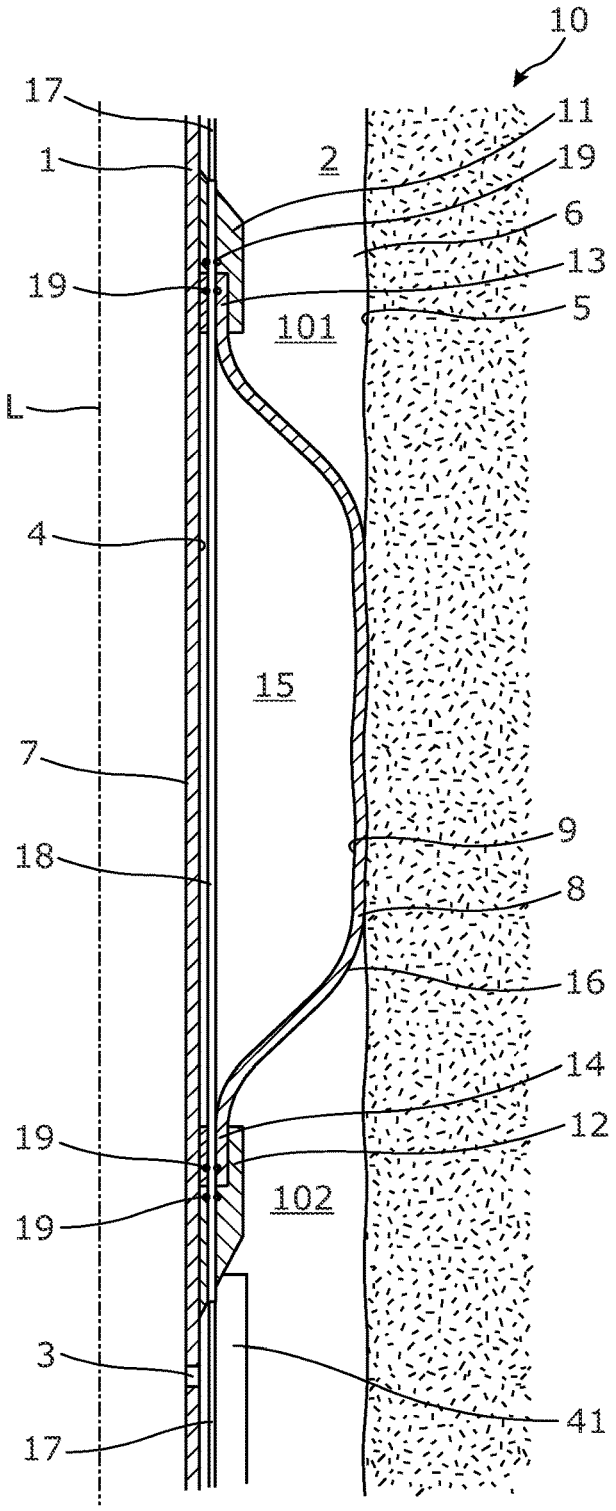
FIG. 3 shows a cross-sectional view of another annular barrier having a tunnel in which the electrical conductor runs.

In FIGS. 2 and 3, the annular barrier 10 is expanded between the well tubular structure 1 and the wall 5 of a borehole 6. In FIG. 2, the first connection part 11 and the second connection part 12 each have an electrical connection 24 connected to the electrical conductor 17, so that the electrical conductor is formed of a first part 35 extending in a first zone 101, a second part 36 extending inside the annular barrier 10, and a third part 37 extending in a second zone 102. The electrical conductor 17 can thus be formed of several parts forming one electrical conductor.

In FIG. 3, the annular barrier 10 further comprises a tunnel 18 in the form of a tube arranged in the annular space 15 and extending between the first connection part 11 and the second connection part 12. The electrical conductor 17 runs in the tunnel 18, and a sealing means 19 is provided around the tunnel and around the electrical conductor 17 so that fluid from the first zone 101 is prevented from flowing into the second zone 102, and vice versa. Instead of having a sealing means 19 around the electrical conductor 17 in the tunnel 18, the tunnel may be designed to collapse at a certain pressure when the annular barrier 10 expands, as the pressure inside the annular space 15 forces the tunnel to collapse and shrink around the electrical conductor. However, the tunnel inside the connection parts is not subject to this high expansion pressure so the connection therein is not jeopardised.

As shown in FIG. 2, the sealing means 19 may also be arranged in such a way that it seals directly around the electrical conductor 17 and is arranged in the connection parts 11, 12 and/or as part of the electrical connections 24. The annular barrier 10 further comprises a sensor 23 electrically connected with the electrical conductor 17 for taking measurements of e.g. pressure and temperature or the expansion ratio of the expandable sleeve 8 during expansion of the annular barrier. As can be seen, the electrical conductor 17 extends further past the sensor 23 to be electrically connected with other electrical devices further down the well.

In FIG. 3, the annular barrier 10 comprises an expansion unit 41 arranged at the first expansion opening 3 so that the pressurised fluid enters the first expansion opening 3 and flows into the expansion unit 41 before being led into the annular space 15. The expansion unit 41 comprises a permanent closing mechanism which closes the fluid communication between the inside of the well tubular structure 1 and the annular space 15 in a first position after expansion of the expandable sleeve 8 and thus the annular barrier 10, and in a second position allows for fluid communication between the first zone 101 and the annular space 15 so that the pressure can be equalised therebetween, should the pressure in the second zone 102 increase during e.g. fracturing. Thus, the permanent closing mechanism is a two-way valve meaning a valve which in a first position provides fluid communication between the inside of the tubular metal part and the annular space within the annular barrier, and in a second position provides fluid communication between the annular space and the annulus between the borehole and the tubular metal part, and when in the first position, the fluid communication to the annulus is closed, and the second position, the fluid communication to the inside of the tubular metal part is closed. The permanent closing mechanism may even function as a three-way valve where fluid may also be led from the well tubular structure to the annulus.

Figure 4:
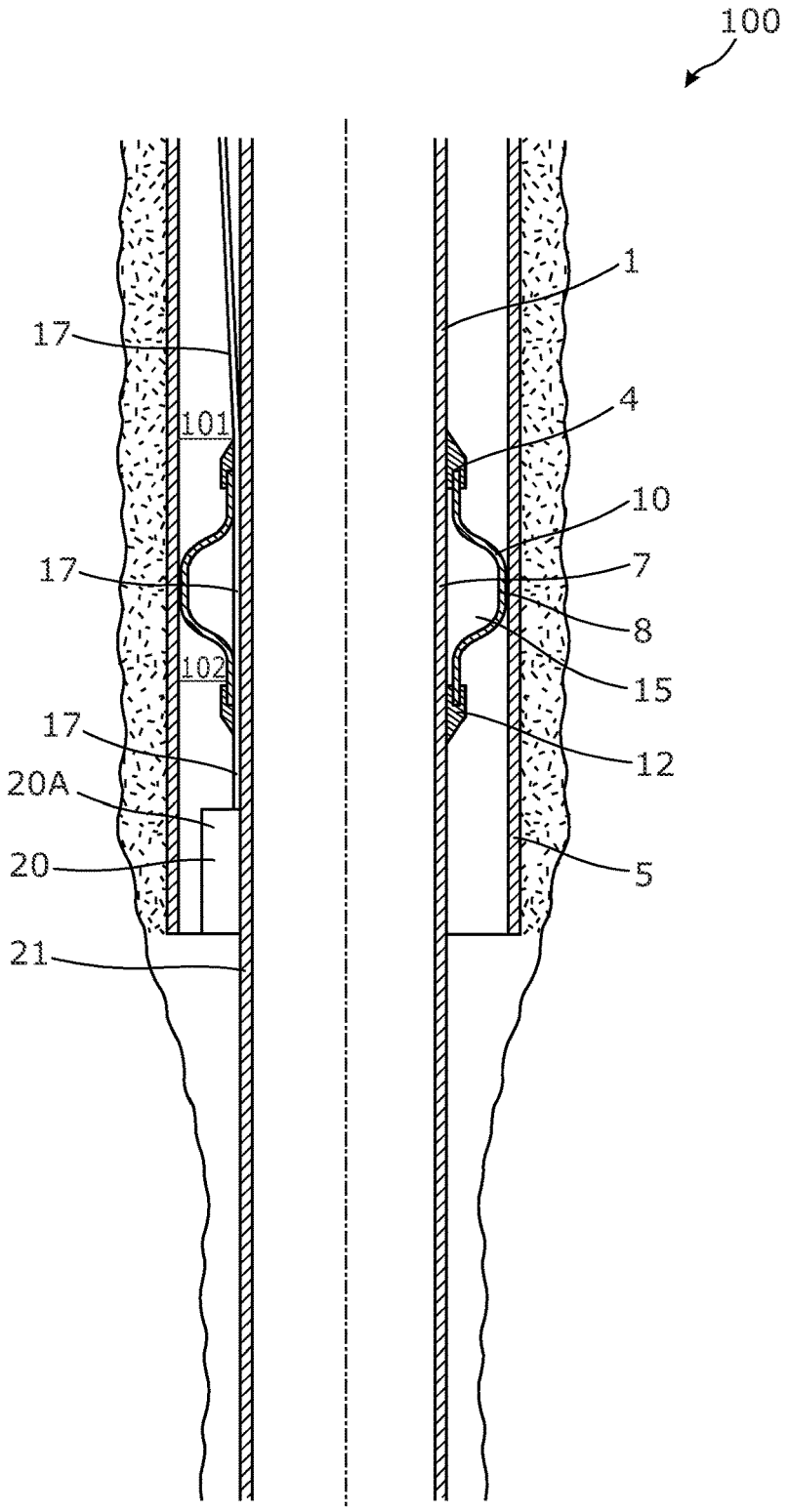
FIG. 4 shows a cross-sectional view of a downhole system.

FIG. 4 shows a downhole system 100 comprising the well tubular structure 1 and a first annular barrier 10 being the annular barrier described above, where the tubular metal part is mounted as part of the well tubular structure. The electrical conductor 17 is led past the annular barrier 10, as described above, without breaking the barrier between the first zone 101 and the second zone 102 provided by the annular barrier 10. Furthermore, the electrical conductor 17 is electrically connected to a first electrical unit 20 arranged on an outer face 21 of the well tubular structure 1. The first electrical unit 20, 2A is an inductive coupler part 20A, meaning that a tool inside the well tubular structure 1 can be recharged by abutting the inner face of the well tubular structure opposite the inductive coupler part, and the tool can thus be charged without having to emerge all the way to surface or the well head, since power is conducted in the electrical conductor past one or more annular barrier(s) and further down the well. Furthermore, the well tubular structure 1 is intact, as the inductive coupler part 20A is arranged on the outside of the well tubular structure.

Figure 5:
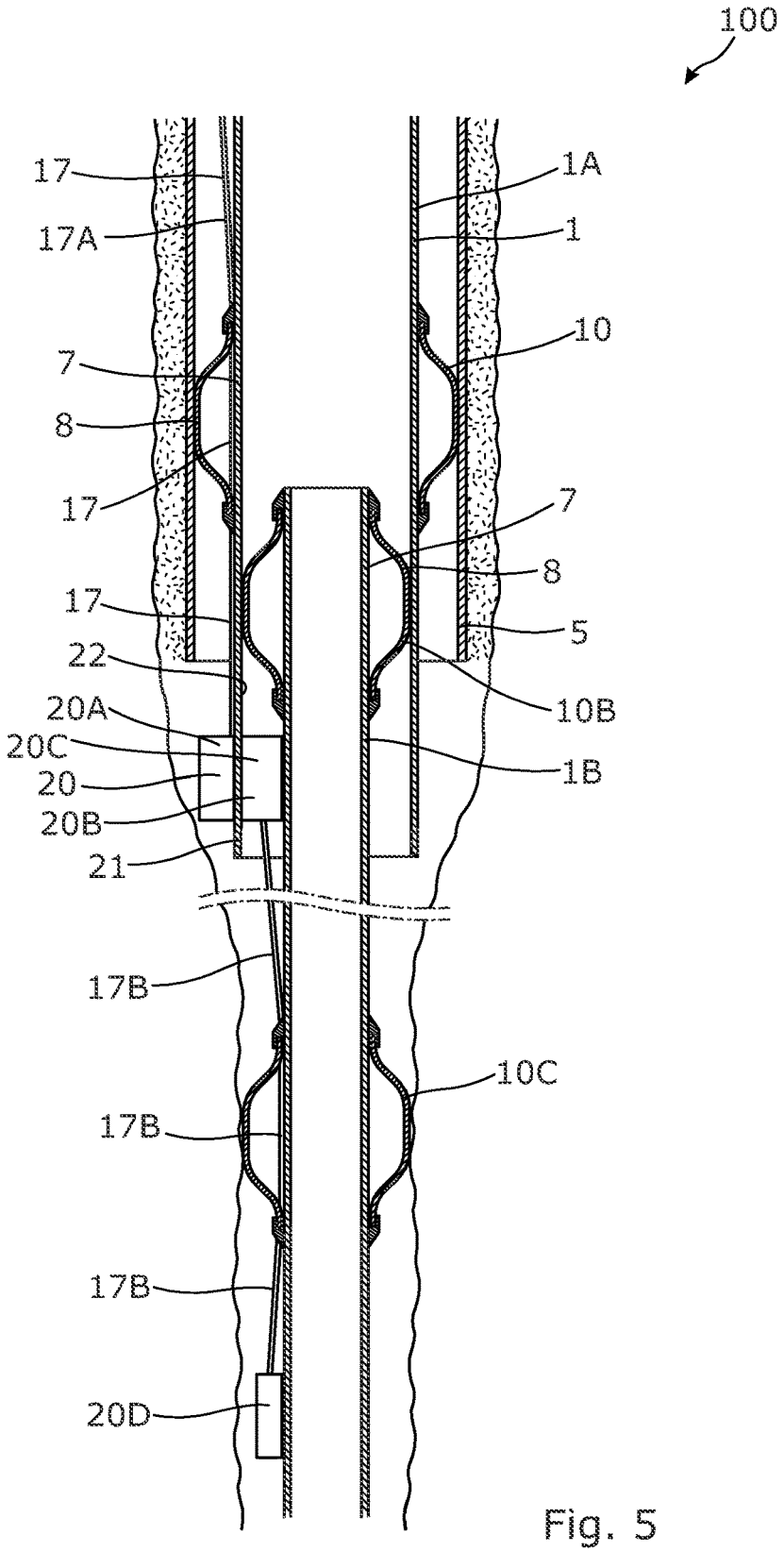
FIG. 5 shows a cross-sectional view of another downhole system having several electrical units.
Figure 8:
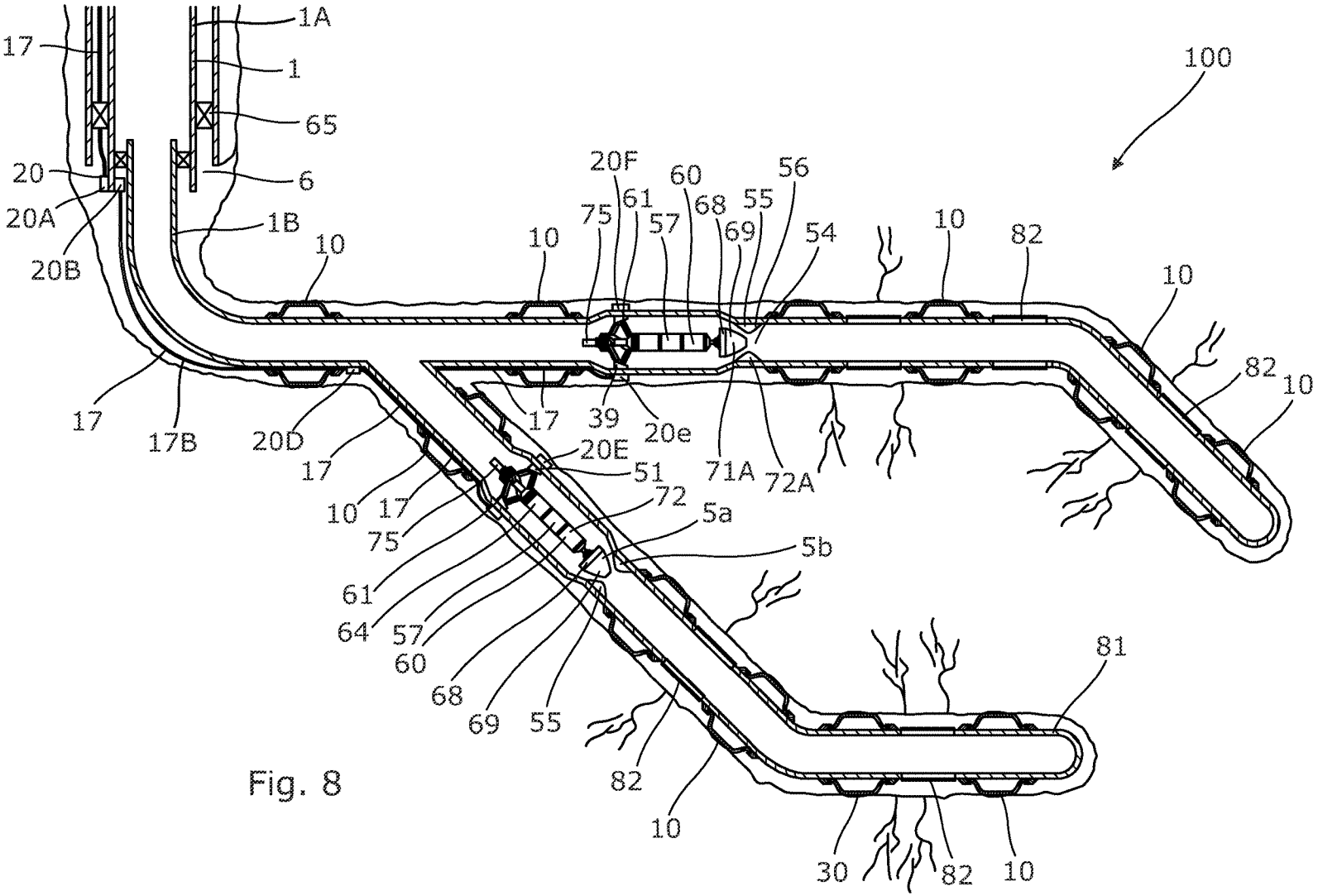
FIG. 8 shows a cross-sectional view of yet another downhole system having several electrical units arranged down the well and in a lateral tubular structure.

The downhole system 100 of FIG. 5 further comprises a second electrical unit 20B arranged inside the first well tubular structure 1, 1A configured to abut an inner face 22 of the first well tubular structure and a second well tubular structure 1B arranged partly within the first well tubular structure 1A. The second electrical unit 20B is an inductive coupler part 20C, and electricity is thus conducted through the first well tubular structure 1A and further conducted in the electrical conductor 17 outside of the second well tubular structure 1B. The downhole system 100 further comprises a second annular barrier 10B having a tubular metal part 7 mounted as part of the second well tubular structure 1B and expanded between the first well tubular structure 1, 1A and the second well tubular structure 1, 1B. The electrical conductor 17, 17A extends through the first annular barrier through the connection parts to the first electrical unit, and a second electrical conductor 17, 17B extends from the second electrical unit 20B through a third annular barrier 10C to a third electrical unit 20D which can then be arranged several kilometers further down the well. The second electrical unit 20B is electrically connected to the third electrical unit 20D via the second electrical conductor 17B, and a tool inside the second well tubular structure 1B can thus be electrically powered several kilometers down the well by abutting the inner face of the second well tubular structure opposite the inductive coupler part of the second electrical unit 20B. The electrical conductor runs through several annular barriers before reaching the fourth electrical unit 20E and may run through even further electrical units and annular barriers, as shown in FIGS. 6 and 8.

Figure 6:
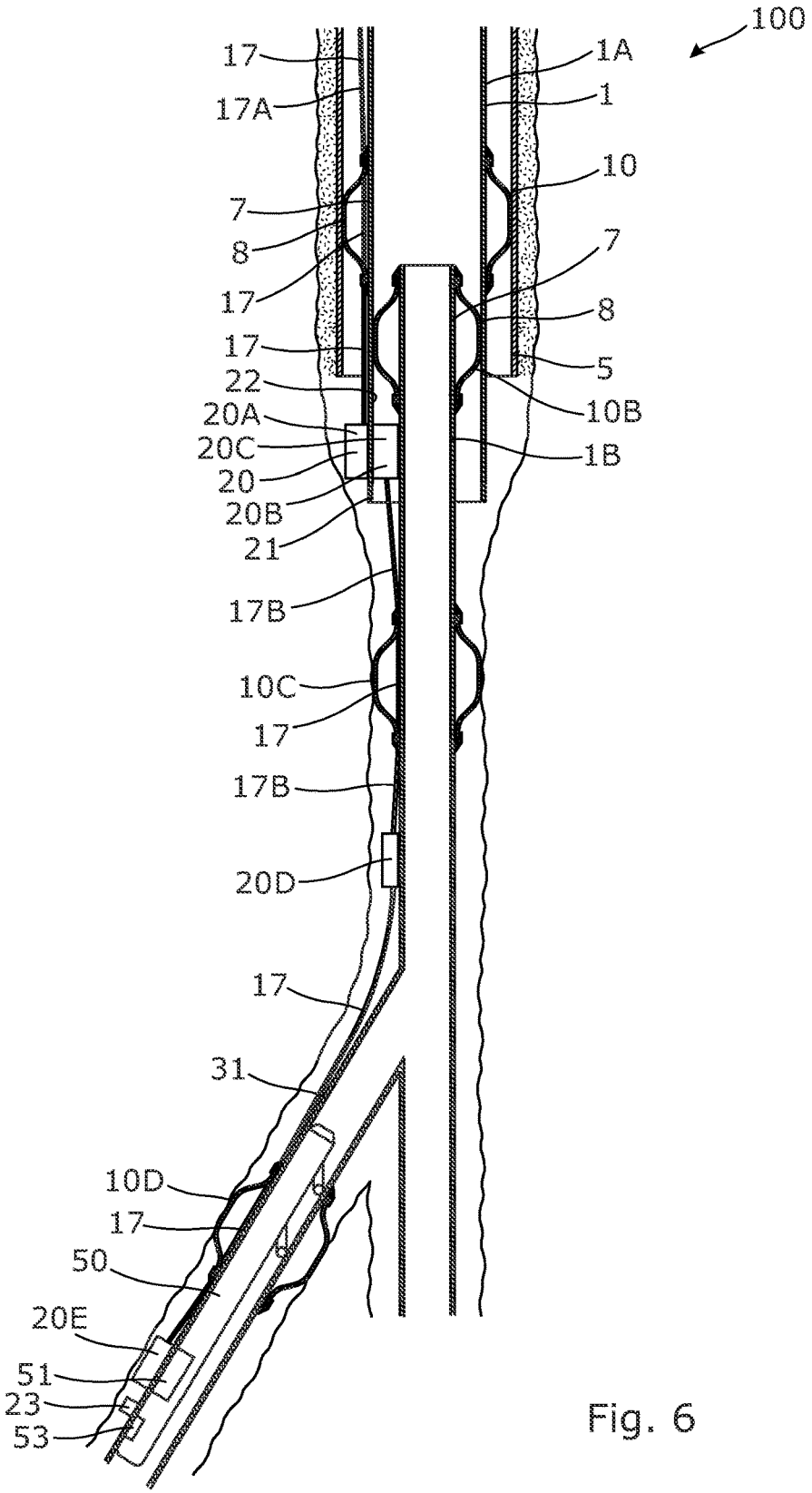
FIG. 6 shows a cross-sectional view of yet another downhole system having a lateral tubular structure with a further electrical unit.

The downhole system 100 shown in FIG. 6 comprises a lateral tubular structure 31 extending from a window opening in the second well tubular structure 1B. The downhole system 100 further comprises a tool 50 arranged in the lateral tubular structure 31 of the well tubular structure 1, and the tool comprises an inductive tool coupler part 51 configured to be electrically connected with the inductive coupler part when the tool abuts the inner face of the lateral tubular structure 31, as shown. The downhole system 100 further comprises a sensor 23 arranged outside one of the second well tubular structures for measuring e.g. temperature and/or pressure.

Figure 7:
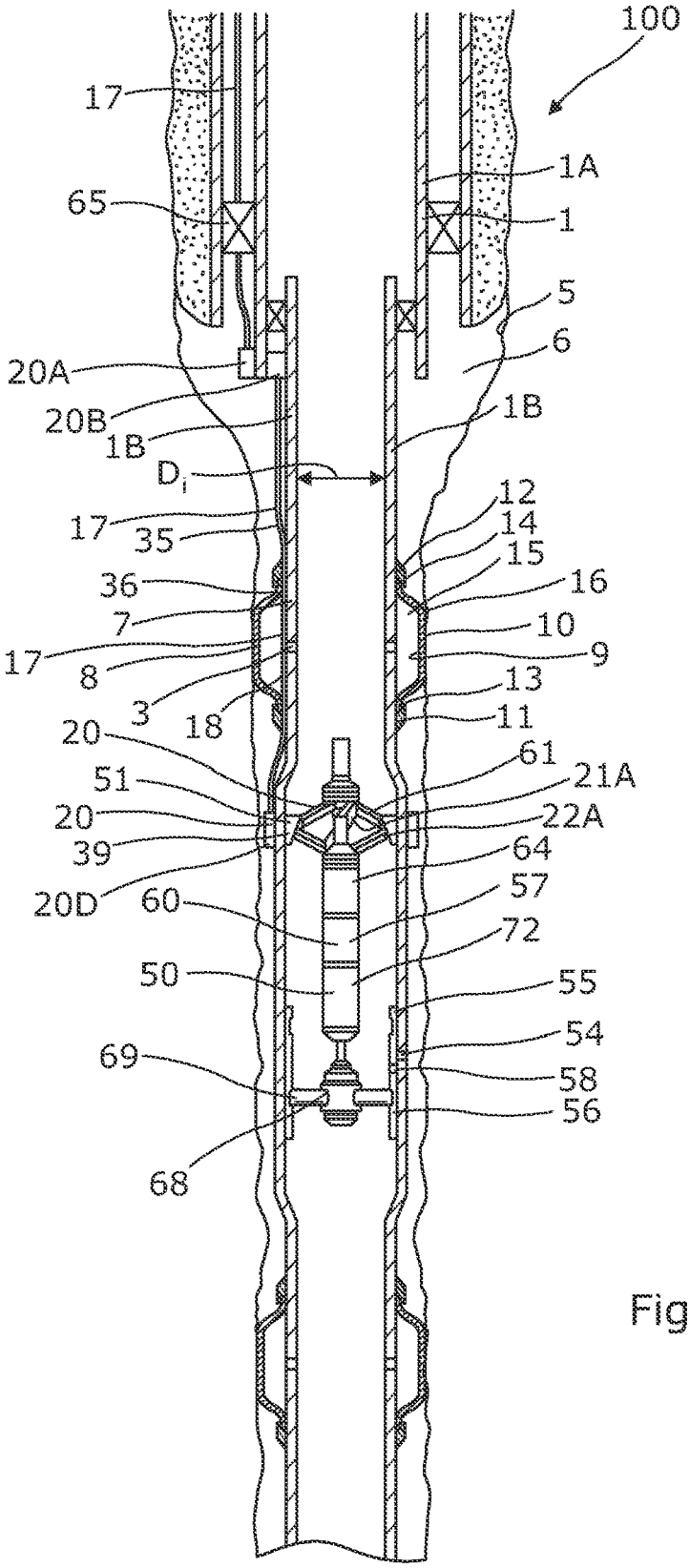
FIG. 7 shows a cross-sectional view of another downhole system having several electrical units arranged down the well.

In FIG. 7, the downhole system 100 has a sleeve 55 movable by the sleeve control 57 for uncovering an aperture 54 or aligning a sleeve opening 58 with the aperture 54 allowing fluid to flow therethrough. The sleeve control 57 further comprises an inductive tool coupler part 51 for receiving control signals from surface to open, choke or close fluid communication through the aperture. The sleeve control 57 is thus permanently installed in the production casing 1B, ready to move the sleeve from one position to another in order to choke, open or close fluid communication from the reservoir. The sleeve control 57 has its own power supply and can operate on its own when receiving a control signal during production of fluid from the reservoir, without the well being intervened by commonly used intervention tools. The inductive tool coupler part 51 of the sleeve control 57 of the tool 50 is arranged in the fixation unit 61 abutting the restriction 39 and the inner face of the casing 1B. The first electrical unit 20A arranged on an outer face of the first well tubular structure 1A and a second electrical unit 20B arranged on an inner face of the first well tubular structure 1A communicate via the casing/well tubular structure 1A. The second electrical unit 20B and the third electrical unit 20D arranged further down the well communicate via the electrical conductor 17 running through an annular barrier 10. The inductive tool coupler part 51 and the third electrical unit 20D are electrically connected via electromagnetic induction and transfer signals and electrical power between them through the well tubular structure 1B. The sleeve control 57 comprises a first part 68 having members 69 engaging the profile 56, and a second part 70 having the fixation unit 61 fixating the sleeve control 57 in the casing. The sleeve control 57 comprises an actuator 72 for moving the first part 68 in relation to the second part 60, and a power supply 64, such as a battery, supplying power to the actuator. The battery may be charged through the well tubular structure 1B by the third electrical unit 20D.

The power supply may also be recharged by the inductive tool coupler part 51 converting mud pulses, an electrical field or acoustic waves into electrical energy. The inductive tool coupler part 51 may also comprise a propeller 21A in connection with a generator 22A for recharging the power supply by converting rotational energy generated by fluid in the production casing 2 into electrical energy, as shown in FIG. 7.

In FIG. 8, the downhole system 100 comprises completion components 55 where a first part 5*a* of the completion component is a member 69 engaging the profile 56 of a second part 5*b* of the completion component. Thus, the first part 5*a* of the completion component is arranged at the component control 57. The inductive tool coupler part 51 of the component control 57 is arranged in the fixation unit 61 abutting the restriction 39 and the inner face of the casing/well tubular structure 1B. The first electrical unit 20A arranged on an outer face of the intermediate casing and a second electrical unit 20B arranged on an inner face of the intermediate casing communicate via the well tubular structure 1A. The first electrical unit 20A is electrically connected to surface via wiring 17 extending through the main barrier 65. The first electrical unit 20A and the second electrical unit 20B are electrically connected via electromagnetic induction and transfer signals and electrical power between them through the intermediate casing 1A. The third electrical unit 20D is connected with the second electrical unit 20B by means of wiring or an electrical conductor, such as a cable, a cord or a wire running through an annular barrier 10. The third electrical unit 20D is arranged on the outer face of the production casing 1B further down the well but above the lateral tubular structure 81. A fourth electrical unit 20E being a fourth communication unit is arranged opposite the inductive tool coupler part 51 of the component control 57. The third communication unit and fourth communication unit/electrical units are electrically connected via wiring 17. The fourth communication unit and the inductive tool coupler part 51 transfer signals and electrical power between them via electromagnetic induction through the production casing 1B. The third electrical unit 20D is furthermore electrically connected with a fifth electrical unit 20F arranged outside the main casing which is the production casing 1B. The fifth electrical unit 20F is arranged opposite the inductive tool coupler part 51 of another component control 57 in the main casing and transfers signals and power by means of electromagnetic induction through the production casing 1B. Both the wiring 17 between the second electrical unit 20B and the third electrical unit 20D and between the third electrical unit 20D and the fourth electrical unit 20E runs past an annular barrier 10. The wiring 17 extends in through one of the connection parts 11, 12 connecting the expandable sleeve 8 with the tubular metal part 7, and past the space 15 and through the other connection part further down the well. The wiring 17 of FIG. 8 between the third electrical unit 20D and the fifth electrical unit 20F extends past the lateral tubular structure 81 on the outside of the main casing 1B and through the annular barrier 10 arranged further down the main casing.

All the communication units each comprise an inductive coupler for transferring power from one communication unit to another through the casing by means of electromagnetic induction. The casing may have non-magnetic sections opposite the communication units to optimise the transfer by electromagnetic induction.

The tool may be a stroking tool which is a tool providing an axial force, e.g. for opening or closing a sliding sleeve. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston. The tool may also be a driving unit/propulsion unit, such as a downhole tractor.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular structure is meant any kind of pipe, tubing, tubular, liner, string etc. used downhole in relation to oil or natural gas production.

In the event that the tool is not submergible all the way into the well tubular structure, a downhole tractor can be used to push the tool all the way into position in the well.

The downhole tractor may have projectable arms having wheels, wherein the wheels contact the inner surface of the well tubular structure for propelling the tractor and the tool forward in the well tubular structure. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole system for completing a well with wireless power and communication downhole, comprising:

a first well tubular structure, a second well tubular structure arranged partly inside the first well tubular structure, a first electrical unit comprising a first inductive coupler part and being arranged on an outer face of the first well tubular structure and electrically connected with an electrical conductor, an annular barrier for being expanded in an annulus between a first well tubular structure and a wall of a borehole or another well tubular structure downhole for providing zone isolation between a first zone having a first pressure and a second zone, the annular barrier comprising:

a tubular metal part for mounting as part of the first well tubular structure, the tubular metal part having a first expansion opening, an axial extension and an outer face, an expandable sleeve surrounding the tubular metal part and having an inner face facing the tubular metal part and an outer face facing the wall of the borehole, a first connection part and a second connection part configured to connect a first end and a second end, respectively, of the expandable sleeve with the tubular metal part, and an annular space between the inner face of the expandable sleeve and the tubular metal part, wherein the annular barrier further comprises the electrical conductor extending on the outside of the tubular metal part and within the expandable sleeve from the first connection part to the second connection part, and a second electrical unit comprising a second inductive coupler part and being arranged inside the first well tubular structure and arranged outside the second well tubular structure and configured to abut an inner face of the well tubular structure, wherein the first electrical unit transfers power and/or communication to the second electrical unit.

2. The downhole system according to claim 1, wherein an outer face of the second well tubular structure faces the wall of the borehole.

3. The downhole system according to claim 1, wherein the second electrical unit is electrically connected to a third electrical unit via a second electrical conductor.

4. The downhole system according to claim 1, further comprising a second annular barrier through which the second electrical conductor extends.

5. The downhole system according to claim 4, wherein the tubular metal part of the second annular barrier is a part of the second well tubular structure.

6. The downhole system according to claim 1, further comprising a lateral tubular structure connected with one of the well tubular structures, and wherein a third electrical unit is arranged outside the lateral tubular structure.

7. The downhole system according to claim 6, further comprising a sensor arranged outside of the lateral tubular structure.

8. The downhole system according to claim 1, further comprising a tool arranged in the second well tubular structure, the tool comprising an inductive tool coupler part configured to be electrically connected with the inductive coupler part.

9. The downhole system according to claim 1, further comprising a sensor arranged outside one of the second well tubular structures.

10. The downhole system according to claim 1, wherein the annular barrier comprises a tunnel arranged in the space between the first connection part and the second connection part, in which tunnel the electrical conductor extends.

11. The downhole system according to claim 1, wherein the connecting parts of the annular barriers connecting the expandable sleeve to the tubular metal part are formed as tubular connection parts having a bore through which bore the electrical conductor runs.

12. The downhole system according to claim 1, wherein the first electrical unit and the second electrical unit communicate wirelessly through the first well tubular structure.

13. The downhole system according to claim 1, further comprising a tunnel arranged in the space between the first connection part and the second connection part, in which tunnel the electrical conductor extends.

14. The downhole system according to claim 13, wherein the first connection part and the second connection part have bores through which the electrical conductor extends.

15. The downhole system according to claim 13, wherein the first connection part and the second connection part each have an electrical connection configured to connect with the electrical conductor.

16. The downhole system according to claim 13, further comprising a sealing means for sealing around the electrical conductor.

17. The downhole system according to claim 13, further comprising a sensor electrically connected with the electrical conductor.

18. The downhole system according to claim 13, wherein the first and second connecting parts of the annular barriers connecting the expandable sleeve to the tubular metal part are formed as tubular connection parts having a bore through which bore the electrical conductor runs.

* * * * *